United States Patent [19]

Tsurumaru et al.

[11] Patent Number: 4,570,165

[45] Date of Patent: Feb. 11, 1986

[54] ADJUSTABLE LOOP AND DIPOLE ANTENNA

[75] Inventors: Shinobu Tsurumaru, Yokohama; Yoshio Ishigaki, Tokyo; Koji Ouchi, Yokohama; Takashi Yoshikawa, Kawasaki; Keiji Fukuzawa, Matsudo; Kazuhiro Imai, Yokohama; Yorimichi Taguchi, Ayase; Masayoshi Tsuchiya, Tokyo, all of Japan

[73] Assignee: Sony Corporation, Tokyo, Japan

[21] Appl. No.: 545,932

[22] Filed: Oct. 27, 1983

[30] Foreign Application Priority Data

Oct. 28, 1982 [JP] Japan ..... 57-189861

[51] Int. Cl.[4] ..... H01Q 1/24; H01Q 9/42

[52] U.S. Cl. ..... 343/726; 343/766; 343/805

[58] Field of Search ..... 343/702, 805, 806, 726

[56] References Cited

U.S. PATENT DOCUMENTS

| | | | |
|---|---|---|---|
| 3,290,689 | 12/1966 | Rieth | 343/805 |
| 3,478,361 | 11/1969 | Middlemark | 343/805 |
| 3,522,608 | 8/1970 | Von Fance | 343/805 |
| 3,587,101 | 6/1971 | Nienaber | 343/702 |

*Primary Examiner*—Eli Lieberman

*Attorney, Agent, or Firm*—Lewis H. Eslinger; Alvin Sinderbrand

[57] ABSTRACT

An antenna apparatus has a first wire-like antenna element formed into a rectangular planar loop and a second antenna element which comprises two L-shaped plates electrically connected to the loop and mounted to a rectangular planar base member. The loop is hinged to the planar base member along long sides of the respective rectangles so that the angle between the planes of the loop and base member is adjustable. The base member pivots about an axis on a mount which can be secured to a television receiver.

16 Claims, 6 Drawing Figures

ADJUSTABLE LOOP AND DIPOLE ANTENNA

BACKGROUND OF THE INVENTION

1. Field of the Invention

The present invention relates to an antenna apparatus and, more particularly, to a compact, indoor antenna for a television receiver.

2. Description of the Prior Art

Prior art television antennas consist of one-dimensional elements. Commonly such antennas are either monopoles, comprising one antenna element, or dipoles, comprising two universally movable antenna elements connected in the familar "rabbit ear" configuration.

A significant drawback with such prior art antennas is the amount of space they require for proper operation. For example, when low-band VHF signals (channels 1–3) are to be received, each one-dimensional antenna element needs to be adjusted to be about 90 cm long. Since such antennas are placed on the television set, which is commonly put near a wall, optimum directional adjustment of such antennas, for example, in inclined positions, is often impossible.

Making the antenna smaller does not solve the problem. If the antenna is smaller, the antenna proficiency is decreased because radiation resistance decreases or because impedance matching between the antenna and the line leading to the television receiver becomes very difficult, particularly in view of the wide band characteristics of television signals.

OBJECT AND SUMMARY OF THE INVENTION

Accordingly, it is an object of the present invention to provide an antenna apparatus which avoids the mentioned shortcomings of the prior art.

It is another object of the present invention to provide an antenna apparatus which can be made small enough for use indoors and which is suitable for association with a television receiver.

In accordance with an aspect of the present invention, an antenna apparatus comprises a multi-dimensional first antenna element, a multi-dimensional second antenna element rotatably mounted to the first antenna element for adjustment of the included angle between the antenna elements, and connecting means for electrically connecting the two antenna elements.

The above, and other objects, features, and advantages of the present invention, will be apparent in the following detailed description of an embodiment thereof.

DETAILED DESCRIPTION OF THE PREFERRED EMBODIMENTS

Figure 1:
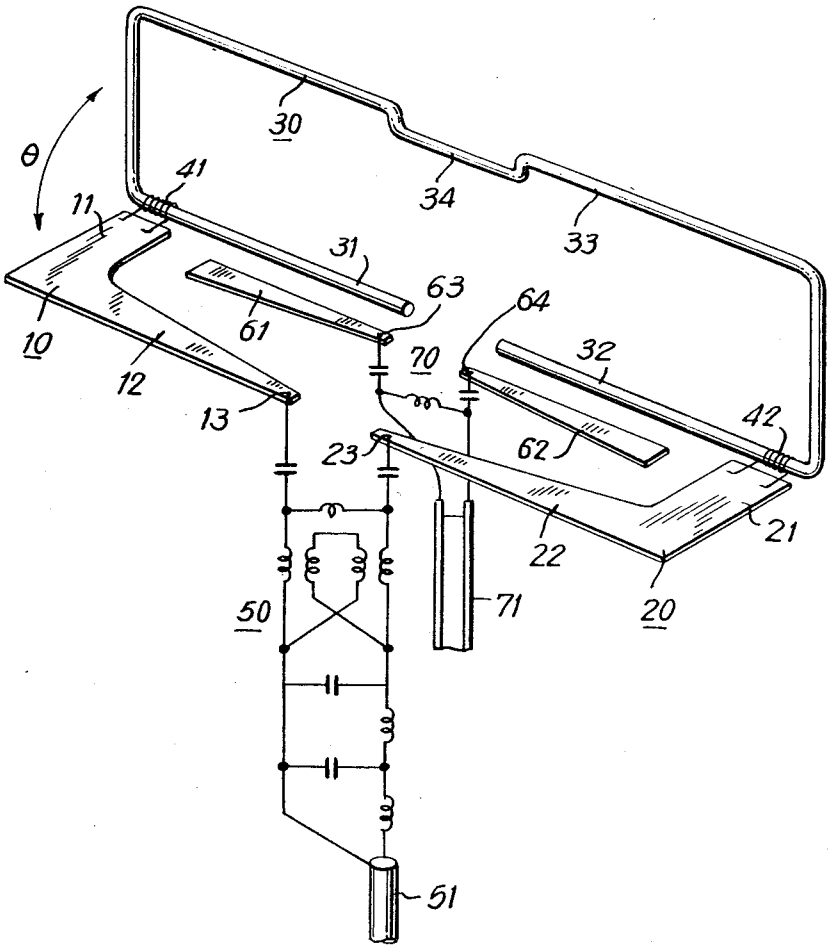
FIG. 1 is a schematic view of antenna elements in an antenna apparatus in accordance with an embodiment of the present invention.

Referring in detail to FIG. 1, it will be seen that an antenna apparatus emboding the present invention essentially comprises a two-dimensional first antenna element 30 in the form of a generally rectangular loop of conductive wire mounted to a two-dimensional second antenna element constituted by a plurality of L-shaped conductive plates 10 and 20. The first plate 10 has two legs 11 and 12. The leg 12 tapers to a first contact point 13 at one end thereof. The second plate 20 also has two legs 21 and 22. The leg 22 tapers to a second contact point 23. The two plates 10 and 20 are disposed in the same plane with the ends of the legs 12 and 22 in mutually facing relationship. The legs 11 and 21 have uniform widths, are of the same length, and are parallel to each other.

The first antenna element 30 is desirably of a conductive wire bent into a generally rectangular loop lying in a flat plane. One long side of the rectangle is comprised of the legs 31 and 32, between the ends of which there is a gap. The opposite long side 33 of the loop has a central offset portion 34.

The first antenna element 30 and the second antenna element comprised of plates 10 and 20 are rotatably mounted to each other so that an angle $\theta$ included between their respective planes is adjustable. The two antenna elements 10, 20 and 30 are electrically connected together, for example, by two coil springs 41 and 42. Each coil spring 41, 42 includes a wound portion which encircles the respective leg 31, 32. The ends of the coil springs terminate in fingers secured to the legs 11 and 21 of the plates 10 and 20.

A matching circuit 50, comprising a plurality of capacitors and inductors arranged as shown on FIG. 1, is connected between contact points 13 and 23 and a coaxial cable 51 which feeds the signal received by the antenna to a television receiver. The impedance of a typical coaxial cable is 75 ohms (Ω) and the matching circuit 50 matches the impedance of the antenna apparatus to that of the coaxial cable 51.

The above described antenna apparatus is suitable for use as a VHF antenna for a television receiver.

It is possible to also provide a UHF antenna in the antenna apparatus embodying the present invention. For this purpose, a third antenna element comprised of two conductive plate members 61 and 62 is disposed in the plane of the plates 10 and 20. The plates 61 and 62 are generally trapezoidal and taper to contact points 63 and 64 of their adjacent ends. A matching circuit 70 matches the impedance of the third antenna element to the impedance of a conventional flat, dual-element antenna wire 71, which typically has an impedance of 300 Ω.

Figure 2:
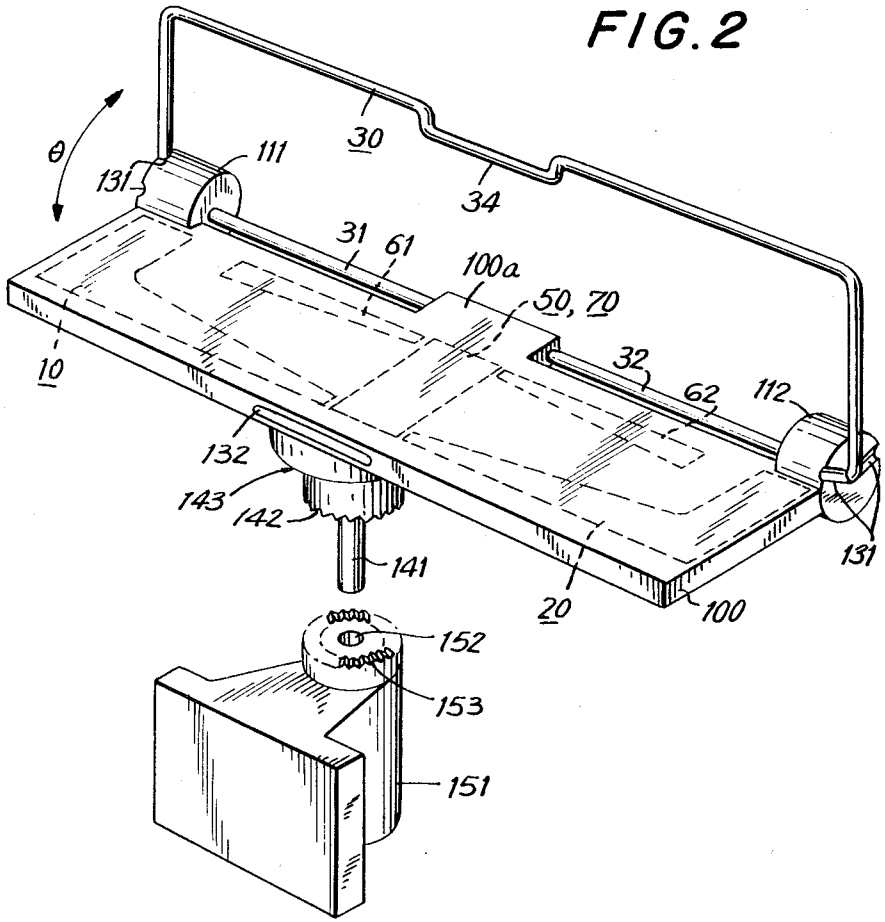
FIG. 2 is an isometric view of a structural arrangement of an antenna apparatus including the antenna elements shown in FIG. 1.

Referring now to FIG. 2, it will be seen that the second antenna element desirably includes a base member 100 made of a plastic material, such as ABS (acrylonitrile-butadiene-styrene) copolymer. The various plate members 10, 20, 61 and 62 are secured to the base member 100 by eyelets, thermal welding, or other suitable means. The impedance matching circuits 50 and 70 can be fabricated on circuit boards which can also be secured to, or housed in base member 100.

The base member 100 has secured to it a pair of hinge blocks 111 and 112. The hinge blocks is 111 and 112 have bores through which legs 31 and 32 of loop 30 rotatably extend. The ends of the legs 31 and 32 are held rotatably in a rearwardly extending tongue 100*a* formed centrally on base member 100. The hinge blocks 111 and 112 and tongue 100*a* support the loop 30 for rotation relative to the base member 100 to change the included angle $\theta$ between the antenna elements. The hinge blocks 111 and 112 include grooves 131 for a purpose described below. In the front edge of the base member 100, a notch 132 is provided. The offset portion 34 of the loop 30 is adapted to resiliently engage in the notch 132 when the loop is folded ($\theta=0$) for storage or when the antenna apparatus is not being used.

The base member 100 further has a downwardly extending shaft 141. A face gear 142 is mounted on a boss 143 molded integrally with the base member 100. The shaft 141, which typically is made of metal (for maximum durability), is embedded in the boss 143 and is surrounded by the face gear 142. The shaft 141 provides a mounting means for the antenna apparatus. A mount 151, which can be secured to the televison receiver, has a central hole 152 molded therein for rotatably accepting the shaft 141. The antenna apparatus can thus be rotated in the plane of base member 100 about the axis defined by shaft 141. The mount 151 also includes a face gear 153 which confronts and cooperates with face gear 142 to prevent inadvertant rotation of the antenna apparatus. Thus, when the antenna apparatus has been directionally oriented, it is held in place by fixing means, comprised of the face gears 142 and 153, against external rotational forces, such as, that exerted by coaxial cable 51 when the antenna apparatus is rotated.

Figure 3:
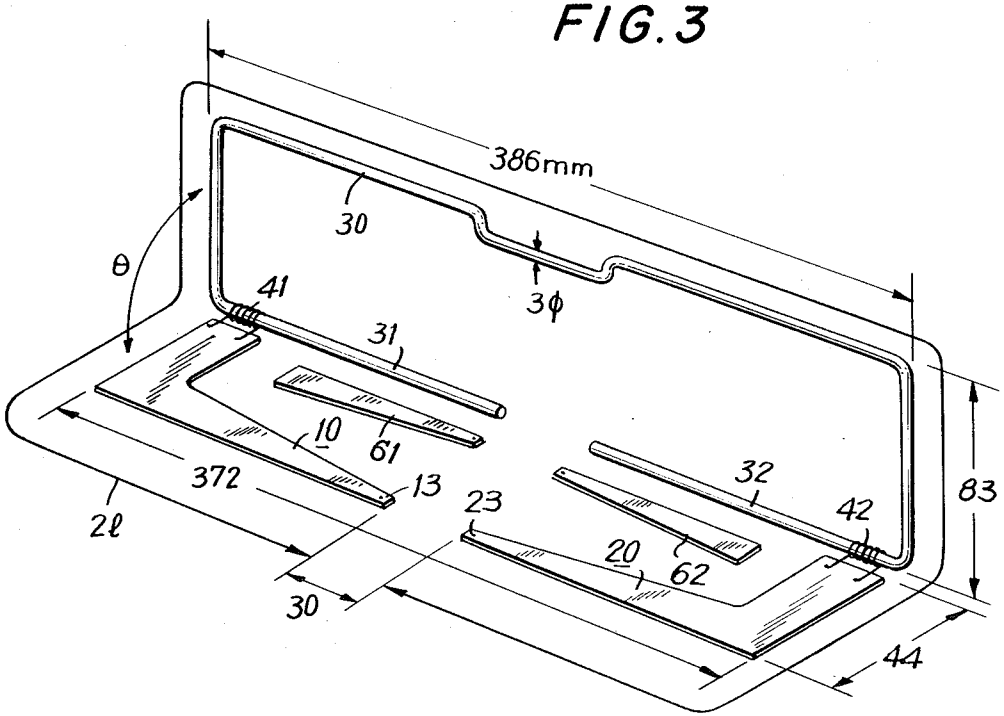
FIG. 3 is a schematic view of the antenna elements shown in FIG. 1 and indicating preferred dimensions thereof.

Referring now to FIG. 3, it will be seen that an antenna apparatus in accordance with the present invention is very compact as compared with the known one-dimensional antenna elements commonly used in the prior art. Typically, the total length $2l$ of the operative antenna shown in FIG. 3 is slightly in excess of 1 meter, which is about 0.3 to 0.35 times the wavelength of signals in the VHF low-band. With such value of the length $2l$, the antenna becomes parallel-resonant with signals having a frequency of about 150 MHz, the wavelength of which is about 2 meters. It will further be seen that the dimensions of the loop 30 and of the plates 10, 20, all of which are shown in millimeters, are such that the L-shaped plates 10, 20 and the plates 61, 62 therebetween can nest within loop 30 when the latter is folded.

Figure 4:
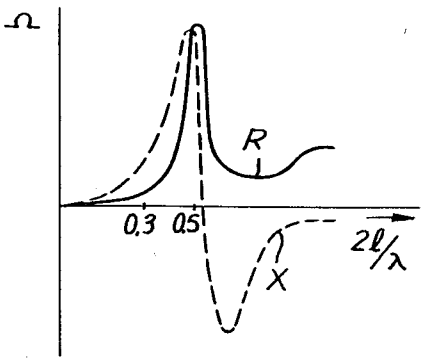
FIGS. 4–6 graphically illustrate the performance characteristics of the antenna apparatus of the present invention.

FIG. 4 graphically illustrates the resistance R and reactance X in ohms ($\Omega$) plotted against $2l/\lambda$, where $2l$ is the length of a loop, as shown in FIG. 3, and $\lambda$ represents the wavelength of the signal being received. As FIG. 4 illustrates, with a signal of about 100 MHz the wavelength of which is about 3 meters, the reactance X is inductive, and the reactance becomes capacitative with a signal of about 200 MHz, the wavelength of which is about 1.5 meters. The resistance component is about 10$\Omega$ at 100 MHz and about 100$\Omega$ at 200 MHz. In the VHF high-band (channels 4–12, or frequencies between about 170 MHz and 222 MHz) such an antenna can be made wide-band resonant by virtue of the matching circuit 50 to provide coverage of the entire VHF high-band. For the VHF low-band (frequencies of between 90 MHz and 108 MHz), however, since the radiation resistance is small, the receiving bandwidth is decreased and neither the whole VHF low-band nor the requisite 6 MHz bandwidth can be covered under those conditions. Although for VSWR (Voltage Standing Wave Ratio) values of about 2 to 3, the requisite channel bandwidth can be obtained, it still is not possible to cover the entire VHF low-band. However, in the antenna apparatus according to the present invention, the adjustability of the angle $\theta$ enables the coupling capacitance to be changed so that the resonant frequency can be changed for each channel in the VHF low-band, and the entire low-band region of the VHF also can be covered by the antenna apparatus of the present invention.

Figure 5:
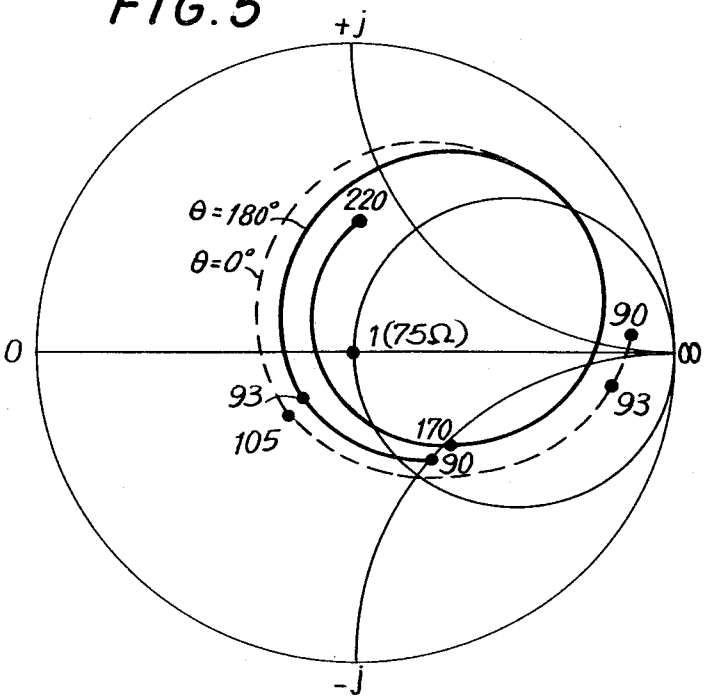

FIG. 5 is a Smith chart which graphically illustrates the impedance characteristics of the antenna emboding the present invention for various values of the angle $\theta$. The solid line in FIG. 5 represents the impedance at $\theta=180°$ and the dotted line represents the impedance at $\theta=0°$. The impedance is shown for various frequencies (90 MHz, 93 MHz, 105 MHz and 220 MHz). Note that the impedance characteristics of the antenna for $\theta=0°$ and $\theta=180°$ are the same above a certain frequency.

Figure 6:
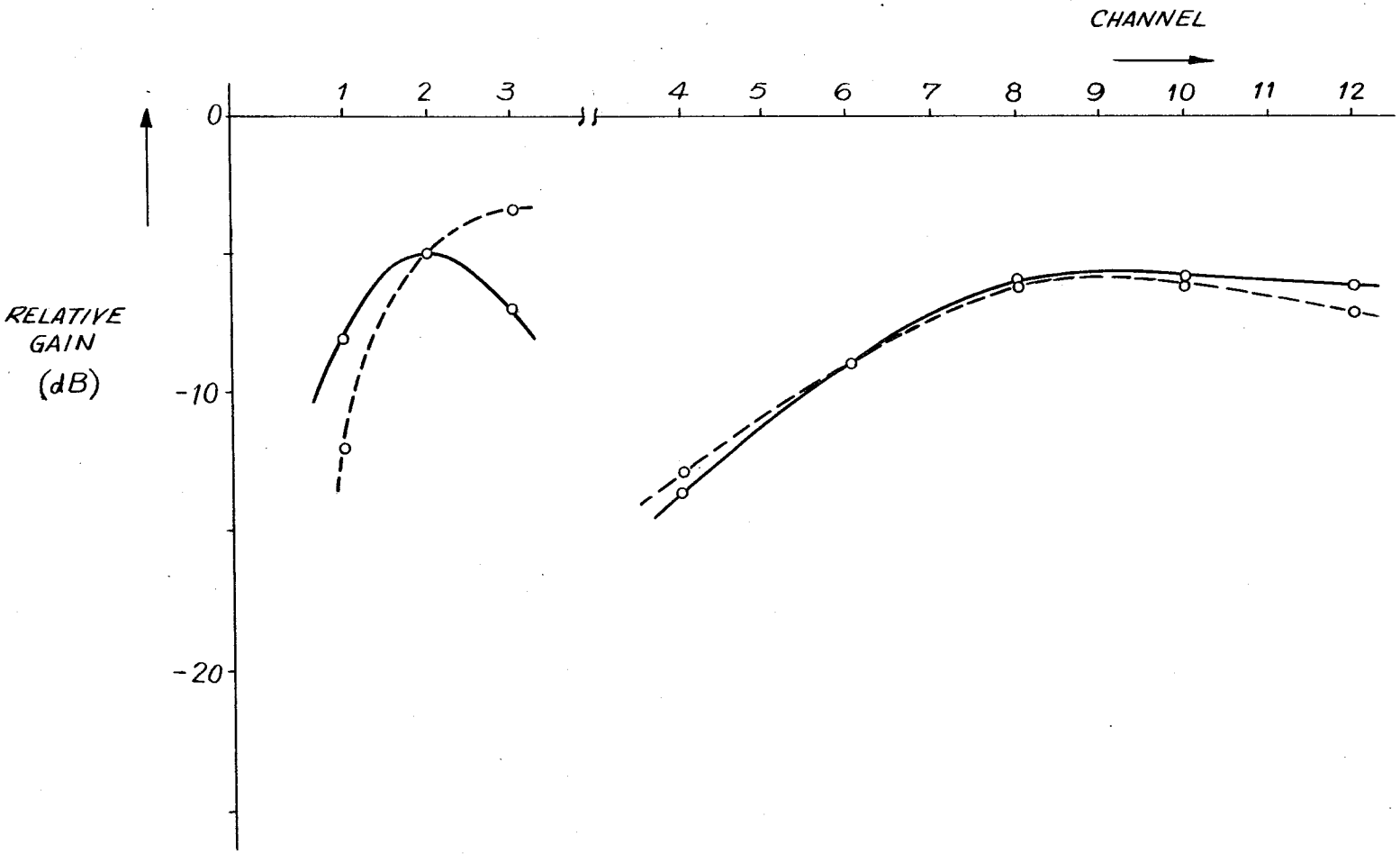

FIG. 6 shows the gain characteristics of the antenna apparatus of the present invention. In FIG. 6, the solid lines represent the antenna apparatus of the present invention and the dashed lines represent the values for a dipole antenna, such as the rabbit ears used in the prior art. FIG. 6 illustrates that the small, compact antenna as shown in FIG. 3 has impedance and gain characteristics comparable to the characteristics of a dipole antenna having antenna elements about 90 cm. long.

The antenna apparatus of the present invention is thus a wide-band resonant type in the high-band region of VHF signals and is also resonant at each channel frequency in the low-band region of the VHF signals, where radiation resistance is small, by virtue of the capability of varying the angle $\theta$.

It is, of course, known in the prior art that the resonant frequency of an antenna can be changed with a varactor diode. However, such devices are disadvantageous because they require a control voltage, which increases the cost of the antenna, and because non-linear distortion can be produced in the presence of the resulting electrical field. However, with the present invention, such increases in cost are prevented and non-linear distortion is avoided because it is the adjustment of the angle $\theta$ which varies the resonant frequency of the antenna. Furthermore, the grooves 131 in the blocks 111 and 112 enable the angle $\theta$ to be set in such a way that it will not be inadvertantly changed.

As those skilled in the art will appreciate, the gain of the present antenna apparatus is increased because the legs 12 and 22 of the plates 10 and 20, respectively, taper to the contact points 13 and 23 so that the voltage at those points is increased. The leg portions 31 and 32 of the loop 30 also increase the gain of the antenna apparatus of the present invention.

The present invention has been described in connection with particular structure. Those skilled in the art will recognize various modifications other than those specifically pointed out which can be made to the embodiments of the present invention described herein without departing from the spirit of the invention. For example, the two antenna elements can be made in more than two dimensions. Therefore, the scope of the present invention is defined solely by the claims which follow.

What is claimed is:

1. An antenna apparatus comprising:

a multi-dimensional first antenna element comprised of a wire formed into a loop in a first plane, said loop being generally in the form of a rectangle with the ends of said wire having a gap therebetween along one long side of said rectangle;

a multi-dimensional second antenna element comprised of a plurality of plate members disposed in a second plane and including at least two L-shaped plates with the ends of one legs of said plates in mutually facing relationship and the ends of the other legs of said plates facing said one long side of said rectangle of the loop;

means for mounting said first and second antenna elements rotatably with respect to each other for adjustment of an angle between said first and second antenna elements, the long side of said rectangle loop having said gap being rotatably mounted in respect to said second antenna element; and connecting means for electrically connecting said first and second antenna elements.

2. The antenna apparatus as in claim 1; wherein said connecting means includes a pair of coiled spring elements each having a wound portion encircling said wire and ending in fingers extending therefrom and secured proximate to said end of said other leg of a respective one of said plates.

3. The antenna apparatus as in claim 1; further comprising a planar third antenna element disposed in the plane of said second antenna element between the legs of said L-shaped plates.

4. The antenna apparatus as in claim 3; wherein said third antenna element comprises a pair of plate elements.

5. The antenna apparatus as in claim 1; wherein said second antenna element includes a base member of a plastic material to which said L-shaped plates are attached.

6. The antenna apparatus as in claim 5; further comprising a matching circuit for matching the impedance of said antenna apparatus to the impedance of a lead for carrying a signal from the apparatus.

7. The antenna apparatus as in claim 6; wherein said matching circuit is attached to said base member.

8. The antenna apparatus as in claim 5; wherein said base member includes hinge blocks secured to said base member for pivotally mounting said loop therein.

9. The antenna apparatus as in claim 8; wherein said base includes a tongue portion having the ends of said loop mounted therein.

10. The antenna apparatus as in claim 8; wherein said hinge blocks have grooves therein for holding said loop in a plurality of predetermined angles relative to said base member.

11. The antenna apparatus as in claim 5; further comprising a mounting member adapted to be secured on a receiver for accepting the signal received by the antenna apparatus, said base member having a shaft secured thereto for mounting said base member for rotation relative to said mounting member.

12. The antenna apparatus as in claim 11; wherein said mounting member and said base member include fixing means for releasably holding said base member in a plurality of predetermined angular positions relative to said mounting member.

13. The antenna apparatus as in claim. 12; wherein said fixing means comprises cooperating face gears on said mount and said base member.

14. The antenna apparatus as in claim 5; wherein said loop includes an offset portion in the other long side of said rectangle and said base member has a notch in one edge thereof for accepting said offset portion to hold said loop in a closed position in which said included angle is zero.

15. A compact antenna apparatus for use as an indoor antenna for a television receiver, the antenna apparatus comprising:

a first planar antenna element comprising a conductive wire formed into a rectangular loop;

a planar rectangular plastic base member;

a second planar antenna element comprising a pair of plates secured to said base member in the plane thereof and electrically connected to said loop to form a VHF antenna therewith;

a third planar antenna element comprising a pair of plates secured to said base member in the plane thereof to form a UHF antenna;

matching circuit means secured to said base member for matching the impedance of said VHF and UHF antennas to leads from the television receiver for the signals received thereby;

hinge means rotatably connecting a long side of said loop to a long side of said base member for adjustment of the included angle between the planes of said loop and base member; and mounting means for rotatably mounting said base member to the television receiver.

16. The antenna apparatus as in claim 15; wherein said loop is about 40 cm by 8 cm and said base member is slightly smaller to permit nesting of said base member within said loop when the latter is folded flat into the plane of the base member.

* * * * *